United States Patent [19]

Guerre et al.

[11] 4,175,920

[45] Nov. 27, 1979

[54] MULTIPLE FUEL SUPPLY SYSTEM FOR STAGED AIR BURNERS

[75] Inventors: Robert P. Guerre, Dover; Dennis L. Juedes, Morris Plains; Ross R. Ruland, Hopatcong, all of N.J.

[73] Assignee: Exxon Research & Engineering Co., Florham Park, N.J.

[21] Appl. No.: 600,730

[22] Filed: Jul. 31, 1975

[51] Int. Cl.[2] ..... F23C 5/28; F23M 9/00; B05B 7/10

[52] U.S. Cl. ..... 431/175; 431/185; 239/400; 239/406

[58] Field of Search ..... 431/284, 185, 173, 174, 431/175, 278, 284, 285; 60/39.74 R, 39.74 B; 239/400, 403, 406, 405

[56] References Cited

U.S. PATENT DOCUMENTS

| | | | |
|---|---|---|---|
| 1,670,626 | 5/1928 | Lalor | 239/400 |
| 1,671,352 | 5/1928 | DeGuise | 431/173 |
| 1,790,395 | 1/1931 | Warner | 431/175 |
| 2,096,945 | 10/1937 | Van Law | 431/185 |
| 2,096,946 | 10/1937 | Van Law | 431/185 |
| 2,320,575 | 6/1943 | Dunn | 431/185 |
| 2,773,350 | 12/1956 | Barrett et al. | 60/39.74 R |
| 2,890,746 | 6/1959 | Dollinger | 431/174 |
| 3,476,494 | 11/1969 | Buchanan et al. | 239/406 |

*Primary Examiner*—Carlton R. Croyle
*Assistant Examiner*—Thomas I. Ross
*Attorney, Agent, or Firm*—F. Donald Paris

[57] ABSTRACT

A staged air burner having a swirl chamber for providing a swirl flow path for primary combustion air, a tangential duct system for providing a tangential flow path for primary combustion air flowing toward the swirl flow path, and a converging passage structure for providing a converging flow path for secondary air which flows along the converging flow path inwardly toward an axis of the swirl chamber downstream of the latter. At least two fuel supply systems are respectively situated at two of the above flow paths for supplying combustible fuel thereto so that it is possible to fire fuel simultaneously at least at two of the flow paths.

3 Claims, 10 Drawing Figures

Fig. 5.
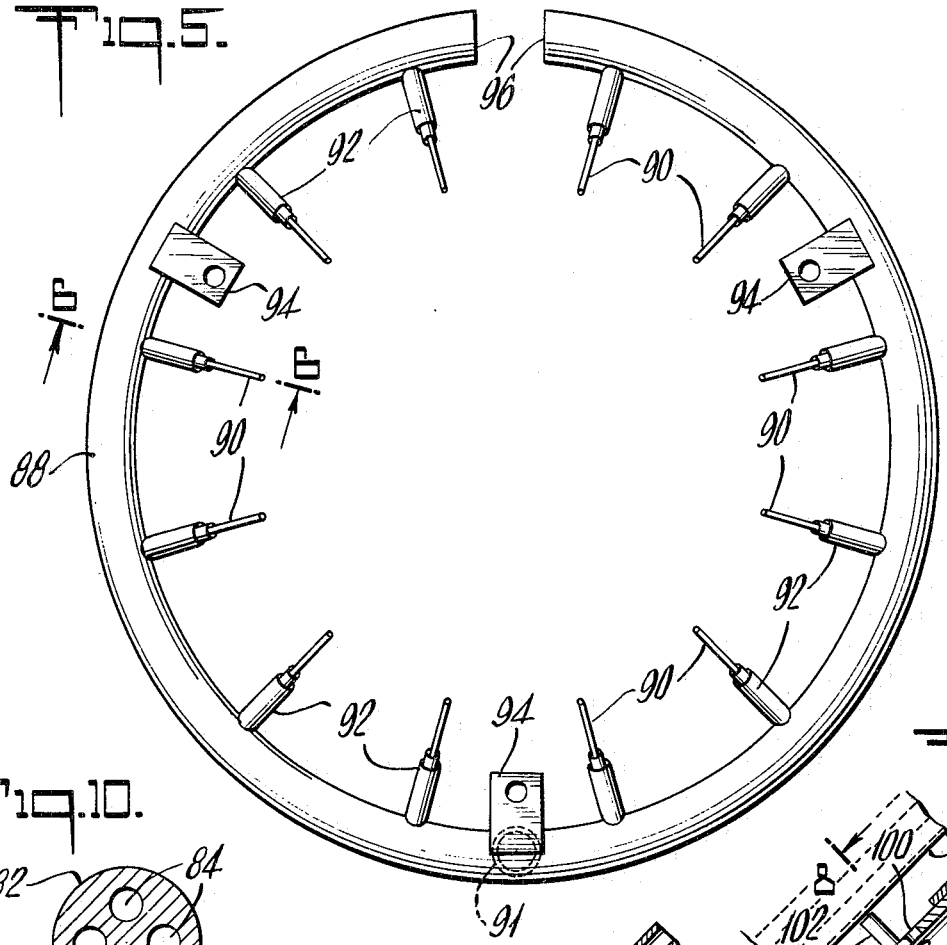
Fig. 10.
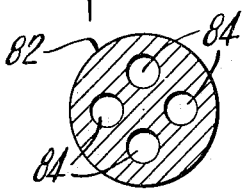
Fig. 7.
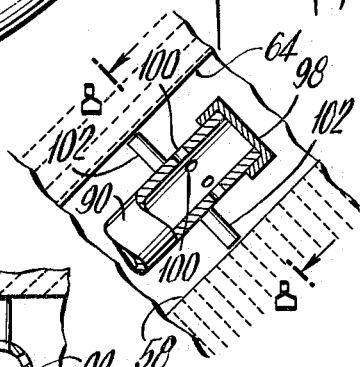
Fig. 6.
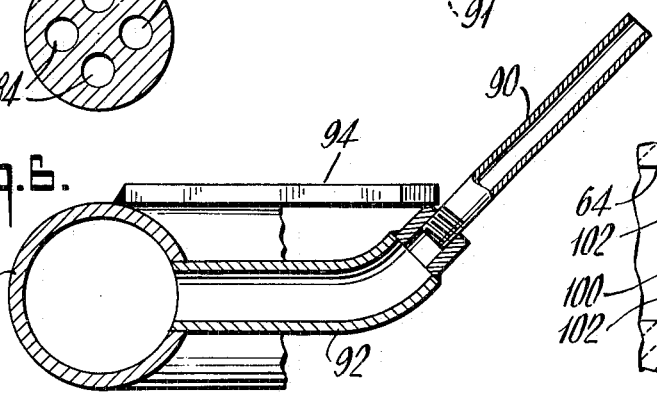
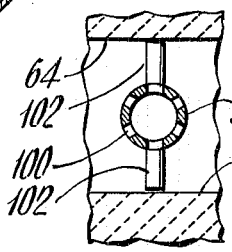
Fig. 8.
Fig. 9.
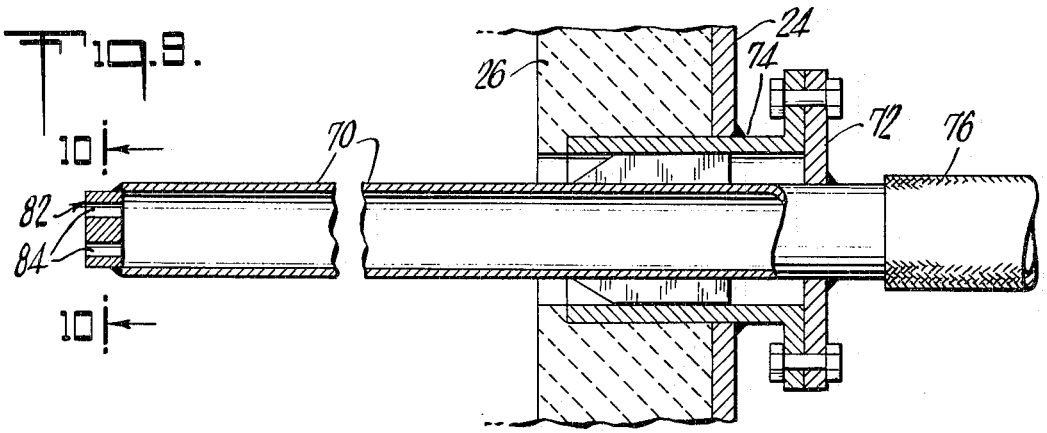

MULTIPLE FUEL SUPPLY SYSTEM FOR STAGED AIR BURNERS

BACKGROUND OF THE INVENTION

The present invention relates to staged air or high intensity burners.

Burners of this general type are shown, for example, in U.S. Pat. Nos. 3,671,173 and 3,746,499.

While burners of this general type have proved to be entirely satisfactory for their intended purpose, experience has shown that certain limitations are encountered with such burners as a result of the fact that combustible fuel is supplied thereto only from a single gun situated centrally along the axis of the swirl chamber of a burner of the above type.

SUMMARY OF THE INVENTION

It is accordingly a primary object of the present invention to provide a staged air burner which is of greater flexibility with respect to the manner in which fuel is burned.

In particular, it is an object of the present invention to provide a construction of the above type which makes it possible to fire fuel simultaneously at more than one location in the burner.

Thus, it is an object of the present invention to provide a construction according to which it becomes possible to fire a single fuel at a number of different locations in the burner or to fire different fuels simultaneously in the burner.

Thus, it is an object of the present invention to provide a burner of the above general type which is capable of simultaneously firing, for example, a gaseous fuel and a liquid fuel, while at the same time being capable of firing fuel at different locations at any desired combination of fuel rates within the maximum firing capacity of the burner.

Furthermore it is an object of the present invention to provide a construction of the above type according to which the fuel is supplied in such a way that nozzles or the like through which the fuel issues will not become clogged and at the same time the entire burner structure will remain clean.

According to the invention the burner includes a swirl chamber means which creates a swirl flow path for primary combustion air, the burner also including a tangential duct means which communicates with the swirl chamber means for creating a tangential flow path for the primary combustion air which travels from the tangential flow path to the swirl flow path. A converging passage means is provided for creating a converging flow path for secondary combustion air which through the converging passage means is directed inwardly toward a central axis of the swirl chamber means downstream of the latter. At least two fuel supply means are situated at least in part at least at two of the above flow paths so that it is possible to fire fuel simultaneously at least at two of these flow paths.

BRIEF DESCRIPTION OF DRAWINGS

The invention is illustrated by way of example in the accompanying drawings which form part of this application and in which:

FIG. 5 is a plan view of one of the fuel-supply means;

FIG. 6 is a sectional elevation of the structure of FIG. 5 taken along line 6—6 of FIG. 5 in the direction of the arrows and showing the structure at a scale larger than FIG. 5;

FIG. 7 is a fragmentary partly sectional illustration of another embodiment of a flame holder or burner nozzle associated with a converging passage means;

FIG. 8 is a fragmentary sectional view of the structure of FIG. 7 taken along line 8—8 of FIG. 7 in the direction of the arrows;

FIG. 9 is a fragmentary sectional elevation of a fuel injection or burner nozzle associated with a tangential duct or primary air jet nozzle of the burner; and FIG. 10 is a sectional view of the nozzle outlet of FIG. 9 taken along line 10—10 of FIG. 9 in the direction of the arrows and showing the outlet at an enlarged scale as compared to FIG. 9.

DESCRIPTION OF PREFERRED EMBODIMENTS

Figure 1:
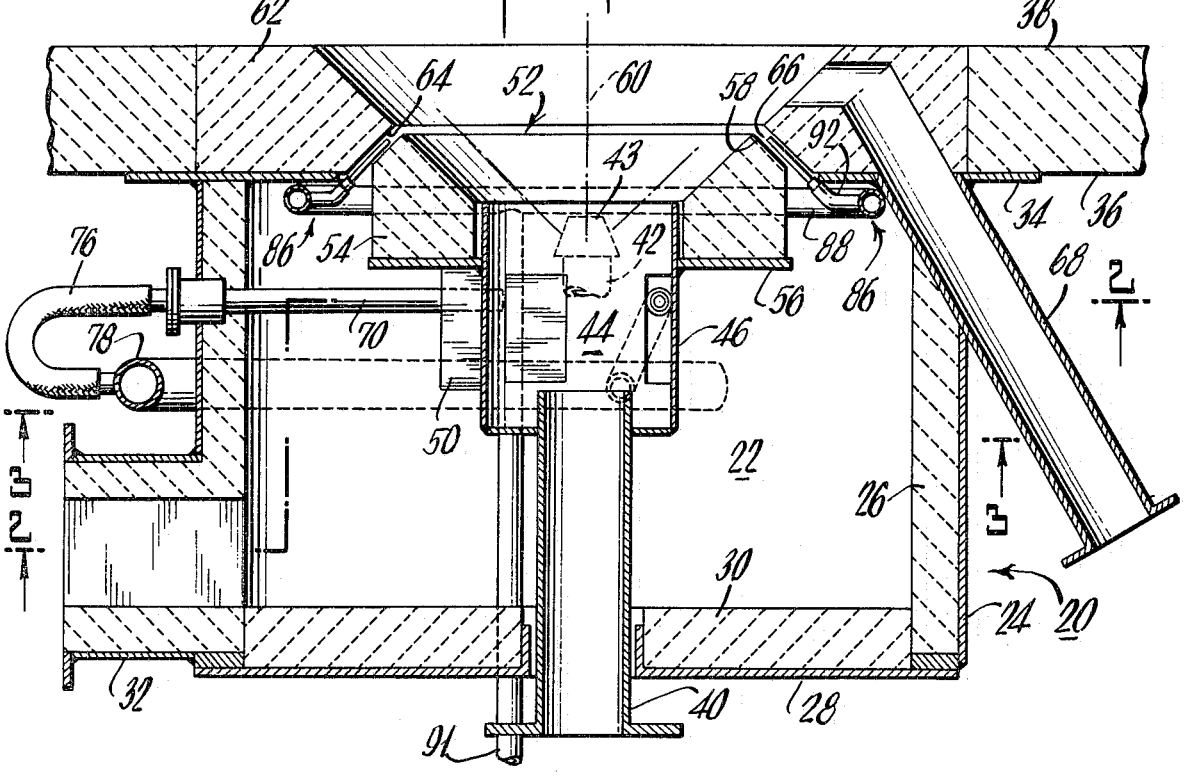
FIG. 1 illustrates in a sectional elevation one embodiment of a staged air burner according to the invention.

Referring to FIG. 1, the staged air burner 20 illustrated therein includes a plenum chamber means 22. This plenum chamber means 22 includes an outer substantially cylindrical wall 24 covered at its inner surface with a suitable layer of refractory thermal insulation 26. The plenum chamber means 22 also includes an inner end wall 28 lined with a suitable thermal insulation 30. As is apparent from FIG. 2 as well as FIG. 1, the plenum chamber means 22 has an inlet 32 of substantially rectangular cross section through which combustion air, which may be preheated, for example, enters into the plenum chamber means 22. The end of the wall 24 distant from the wall 28 is fixed with a circular wall or flange 34 which in turn is fixed in any suitable way to the outer surface 36 of a wall 38 which is fragmentarily illustrated in FIG. 1 and which may form a side wall or floor of a furnace.

The end wall 28 of the plenum chamber means 22 is formed with a central aperture in which a pipe 40 is accommodated in a fluid-tight manner, and this pipe 40 is provided to support a fuel supply means 42 (shown in dotted lines) which extends along the central axis of the chamber 22 and which is connected in known suitable fluid-tight manner to the pipe 40. The fuel supply means 42 is in the form of a suitable gun having an outlet nozzle 43 through which a liquid fuel combined with steam, for example, is sprayed to be burned in a manner described in greater detail below.

The pipe 40 carries within the plenum chamber means 22, coaxially with the latter, a swirl chamber means 44 forming a primary air swirl chamber and having a cylindrical wall 46 the axis of which coincides with the axis of the fuel-supply gun 42 as well as the axis of the chamber 22.

A tangential duct means 48 (FIG. 2) communicates with the interior of the swirl chamber means 44. Thus, as is apparent from FIG. 2, the tangential duct means 48 includes four ducts 50 of substantially rectangular cross section forming primary air jets and projecting tangentially from the cylindrical wall 46, while being uniformly distributed about the axis of the swirl chamber means 44. Thus, with this construction primary air under pressure in the plenum chamber 22 will flow through the tangential duct means 48 along a tangential flow path into the swirl chamber means 44 which creates a swirling flow path for the primary combustion air which thus burns with the fuel provided by way of the fuel-supply means 42.

In addition to the above tangential and swirl flow paths provided for the primary combustion air, a converging flow path is provided for the secondary combustion air. For this purpose a converging passage means 52 is provided. The converging passage means 52 includes an inner refractory ring 54 which surrounds the swirl chamber means 44. Thus the wall 46 of the chamber means 44 has at its exterior a flange 56 on which the refractory ring 54 is mounted, for example by way of suitable wire anchor means (not shown). The inner ring 54 has an inclined outer surface 58 which forms part of a cone whose apex is situated along the axis 60 of the swirl chamber means 44 downstream of the latter.

The converging passage means 52 further includes an outer refractory ring 62 which is fixed to the circular plate 34 and forms a continuation of the furnace wall 38. This outer refractory ring 62 has an inner surface 64 directed toward but spaced from the surface 58 and also forming part of a cone whose apex is on the axis 60 downstream of the swirl chamber means 44. The apex angles of the cones of which the surfaces 58 and 64 form a part are substantially equal to each other, and the surface 64 is spaced from the surface 58 so as to define with the latter the converging gap 66 through which the secondary combustion air travels so as to converge inwardly toward the axis 60 downstream of the swirl chamber means 44. This flow will contribute to proper shaping of the flame as well as a much more efficient combustion and a maintenance of the cleanliness of the assembly. The burner is provided with the usual pilot guide tube which is not illustrated as well as with a pilot light-off tube 68.

In the particular example illustrated in the drawings, in addition to the fuel supply means 42 situated at the swirl flow path for the primary combustion air, a pair of additional fuel supply means are respectively situated at the converging flow path provided by the converging passage means 52 as well as at the tangential flow path provided by the tangential duct means 48.

Figure 2:
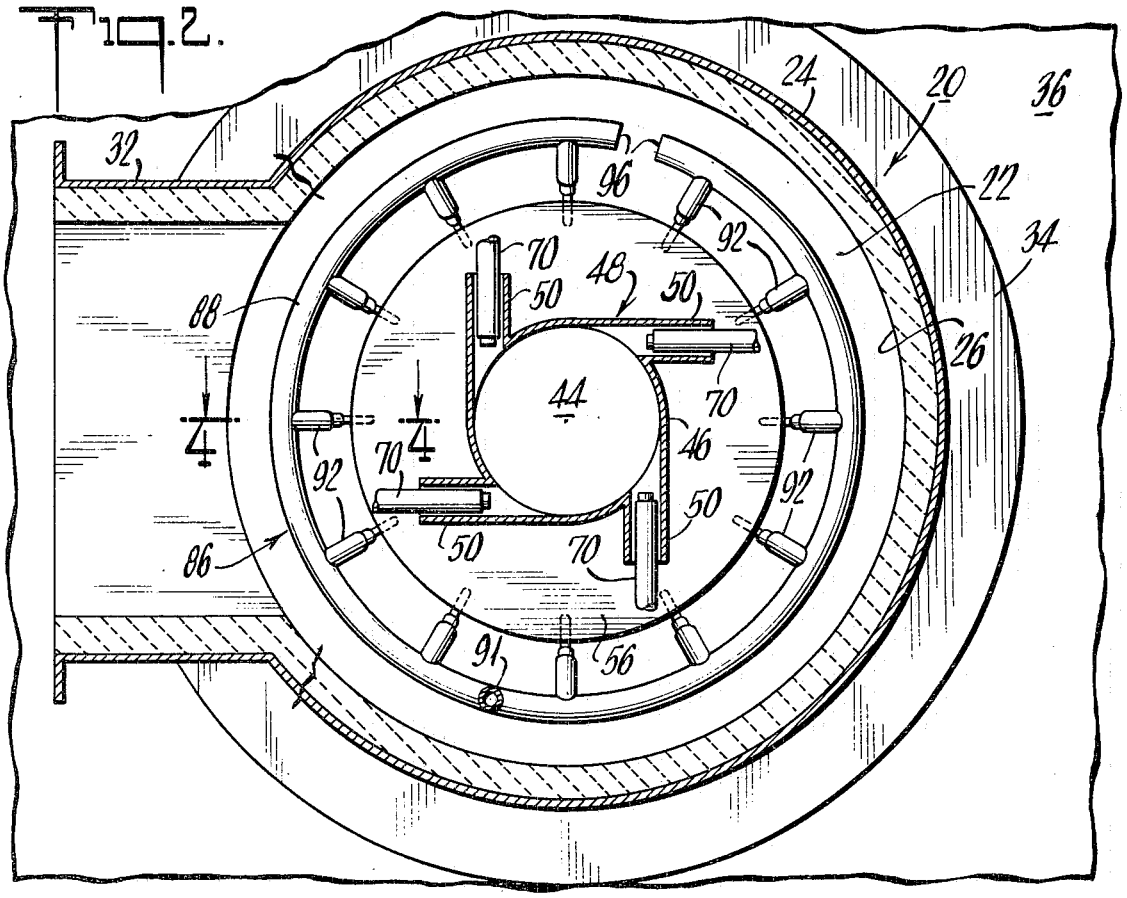
FIG. 2 is a fragmentary transverse section of the structure of FIG. 1 taken along line 2—2 of FIG. 1 in the direction of the arrows.
Figure 3:
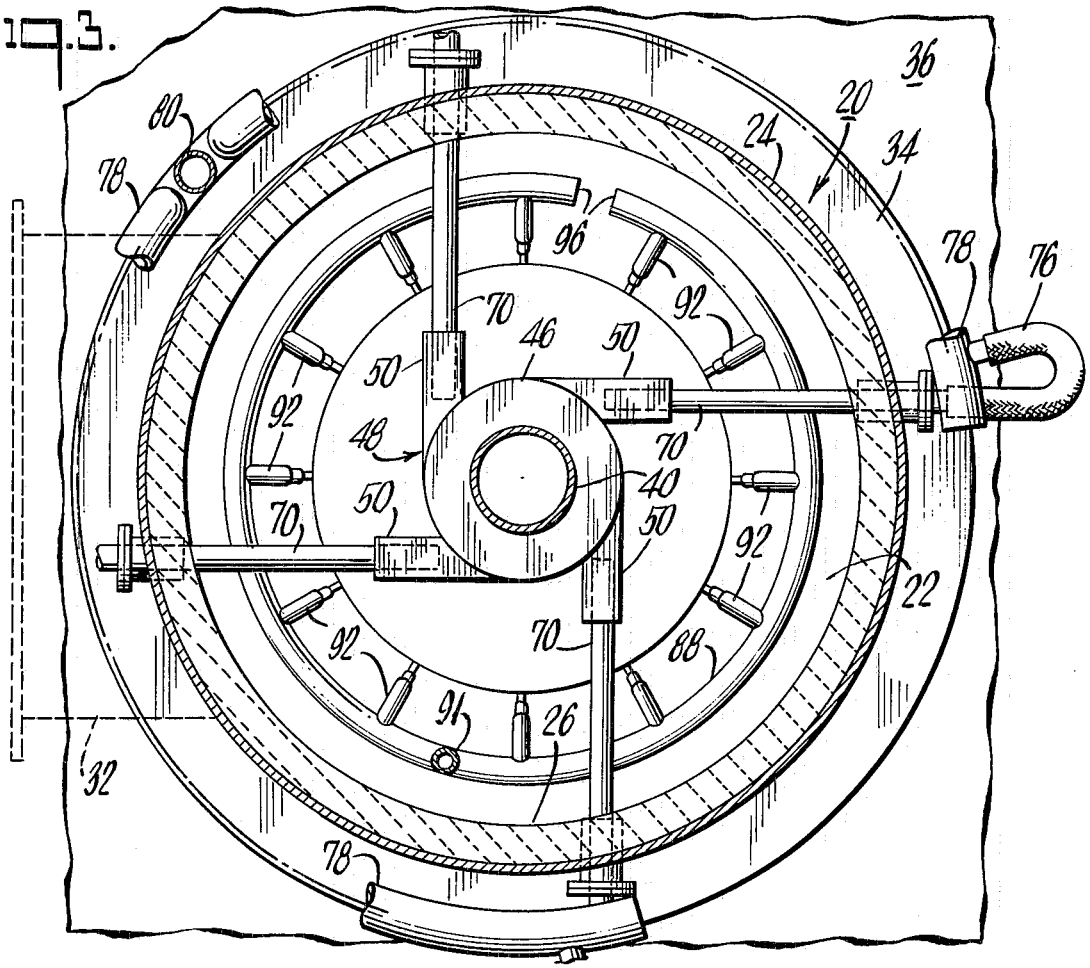
FIG. 3 is a fragmentary transverse section of the structure of FIG. 1 taken along line 3—3 of FIG. 1 in the direction of the arrows.

The fuel supply means at the tangential duct means 48 includes a plurality of burner or fuel-injector nozzles 70 respectively situated in the tangential ducts or primary air jets 50 in the manner shown fragmentarily in FIG. 2. The arrangement of the fuel injectors 70 is also apparent from FIG. 3. As may be seen from FIGS. 9 and 10, each nozzle 70 is in the form of a tube extending through and welded to a mounting plate 72 which is fastened to the flange of a sleeve 74 which extends into a bore formed in the insulation layer 26 as well as through an opening in the wall 24. Thus, the several tubes 70 will extend through the plenum chamber 22 into the tangential ducts 50 in the manner shown in FIG. 3. Outwardly beyond the mounting plates 72, the tubes 70 are connected with curved flexible tubes 76 which in turn communicate with a manifold or header 78 situated outside of and adjacent the plenum chamber means 22. The header 78 communicates with a supply pipe 80 (FIG. 3) which is in communication with a suitable source of a combustible fuel such as a gaseous fuel, for example.

As may be seen particularly from FIGS. 9 and 10, the several tubes 70 respectively terminate in end walls 82 each of which is formed with a plurality of small bores 84 through which the gaseous fuel issues. Thus, this particular fuel will issue from the several tubes 70, out through the bores 84 into the several tangential ducts 50 so that the tangential flow path primary air fuel is capable of supporting combustion independently of and if desired simultaneously with combustion of liquid supplied through fuel gun means 42. The pair of fuel supply means described above can be used to fire either the same fuel simultaneously at the swirl flow path and the tangential flow path, at both of which the primary combustion air is provided, or different fuels may be simultaneously fired at these two flow paths with the above-described structure.

Figure 4:
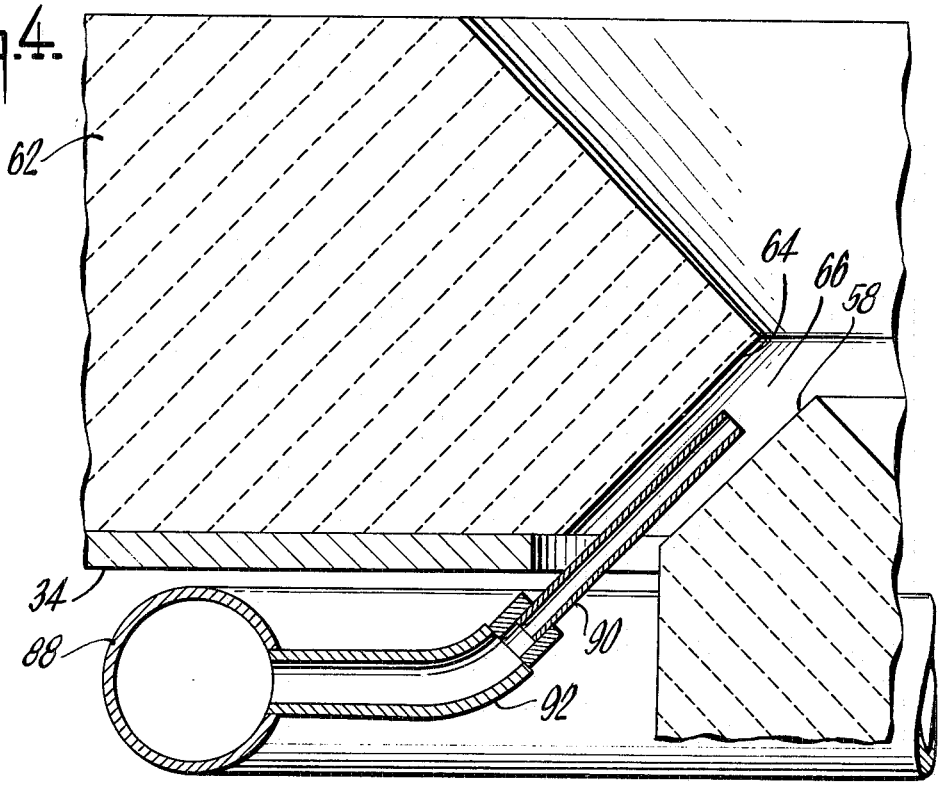
FIG. 4 is a fragmentary sectional elevation taken along line 4—4 of FIG. 2 in the direction of the arrows and showing part of the fuel supply means associated with a converging passage means at a scale which is enlarged as a compared to FIG. 2.

In the example of the invention illustrated in the drawings, however, there is an alternate third fuel supply means 86 which includes a manifold or header 88 communicating through a pipe 91 with a suitable source of gaseous fuel. The pipe 91 passes fluid-tightly through a suitable opening which is formed in the wall 28 and lining 30 of the plenum chamber means 22, and at its upper end, as viewed in FIG. 1, the pipe 91 communicates with the header 88 so as to supply fuel to the interior thereof. The header 88 in turn communicates with a plurality of burner nozzles 90 through suitable tubular connections 92, as shown in FIG. 4. The header 88 is fixed to the under surface of the plate 34 which is directed toward the interior of the plenum chamber means 22. Thus, for this purpose the header 88 is fixed with a plurality of mounting plates 94 shown in FIG. 5 and capable of being fixed by any suitable fasteners to the plate 34 shown in FIG. 1. Thus, the header 88 is situated within the plenum chamber means 22 and extends along a circle which coaxially surrounds the ring 54, this header 88 having, for example, a pair of closed ends 96.

The several burner nozzles 90 are respectively situated along elements of a cone which is situated between the cones of which the surfaces 58 and 64 respectively form parts, and it will be seen from FIG. 4 that the burner nozzles 90 are spaced from the surfaces 58 and 64 while being situated therebetween in the gap 66. Moreover, as is apparent from FIGS. 2, 3 and 5, the several nozzles 90 are uniformly distributed about the axis 60. Thus, with this construction the fuel of the supply means 86 will be supplied at the converging flow path for the secondary air to enable in this way even a third fuel to be burned so that any desired combination of three fuel sources may be simultaneously ignited in the burner of the invention, if desired, although it is also possible to provide any desired combination of two fuels with any two of the above three fuel supply means, and it is of course possible to provide any desired flow rates for the different fuels or different flow rates for the same fuel provided by two or more of the above fuel supply means. In this way it is possible with the invention to increase the utility of the burner by providing it with the capability of simultaneously firing one or more fuels at a number of different locations with any desired fuel rates, within the maximum firing capacity of the burner. Thus, for example, it is possible with the invention to simultaneously fire two gaseous and one liquid fuel, gaseous fuel from one source, gaseous fuel from two sources, or other obvious combinations of fuels.

Instead of burner nozzles 90 as shown in FIG. 6, for example, it is possible to close the ends of the nozzles 90 with suitable closure caps 98, one of which is shown in FIG. 7. In this case, the wall of the nozzle 90 is provided with a plurality of apertures 100 through which the fuel escapes. As shown in FIGS. 7 and 8, a pair of coaxial pins 102 may be fixed to each nozzle 90 extending radially therefrom into engagement with the surfaces 58 and 64 so as to provide a more robust mounting for the nozzles 90 and act as flame holders as well. Of course, these pins 102 may also be used with tubes 90 as shown in FIG. 6 where the fuel flows out through the open end of the tubes 90.

With the arrangement of the gaseous fuel supply nozzles 90 and 70 as shown relative to positioning of the liquid fuel nozzle 43, it will be readily seen that fouling thereof with liquid fuel from nozzle 43 during simultaneous burning of two different fuels or operation of the burner on 100 percent liquid fuel through the center nozzle will be prevented.

What is claimed is:

1. In a staged air burner, cylindrical swirl chamber means for creating a first swirl flow path for primary combustion air betwen an inlet and outlet thereof, tangential duct means communicating tangentially with said inlet of said swirl chamber means for creating a second tangential flow path for primary air entering said swirl chamber means to flow therein along said swirl flow path, passage means located axially downstream of and substantially adjacent said outlet of said swirl chamber means and surrounding and converging toward a central axis of said swirl chamber means for creating a third converging flow path for secondary combustion air to be directed inwardly toward said axis downstream of and substantially adjacent said outlet of said swirl chamber means, and at least two fuel supply means respectively situated at least in part at two of said first, second and third flow paths for selectively supplying at least one combustible fuel to said two flow paths, so that fuel from both of said fuel supply means may be simultaneously fired, wherein said swirl chamber means includes an outer cylndrical wall surrounding said axis and said tangential duct means includes a plurality of ducts respectively communicating through said cylindrical wall with the interior of said swirl chamber means and respectively projecting tangentially from said wall while being distributed about said axis, one of said two fuel supply means including a plurality of fuel injectors respectively situated in corresponding ones of said tangential ducts.

2. The combination of claim 1 and wherein said fuel injectors in said tangential ducts respectively have end walls each formed with a plurality of openings through which fuel escapes into said ducts while flowing toward said inlet of said swirl chamber means.

3. A chamberless staged-air vortex burner for use in the burning of fuels and adapted to be mounted in a furnace wall having an opening therein comprising in combination, burner casing means having an air inlet adapted for receiving an inlet air flow, air induction chamber means having an inlet and an outlet and mounted within said burner casing for receiving a predetermined portion of said inlet air flow and producing an uninterrupted helical vortex primary air flow from said outlet, a first fuel injection means located in said chamber means having a discharge end at the outlet thereof for injecting fuel into said helical vortex primary air flow from said oulet, refractory means mounted in said casing about said chamber outlet, air gap means adapted to receive the remaining portion of said inlet air flow, said air gap means being of substantially uniform annular configuration extending through said refractory means and located between said outlet and the plane of said furnace wall, said air gap means being angularly disposed relative to the plane of said furnace wall for projecting secondary air flow in an outward direction relative to said outlet of said induction chamber and inwardly toward the axis of said chamber for containment of the flame envelope and a second fuel injection means located at said inlet for introducing a gaseous fuel into said air induction chamber means upstream of the discharge end of said first fuel injection means whereby fuel fired from said first fuel injection means will not impinge upon and plug said second fuel injection means during simultaneous firing thereof, including a third fuel injection in said air gap means whereby fuel fired from at least one of said first and second fuel injection means will not impinge upon and plug said third fuel injection means.

* * * * *